US005449885A

United States Patent [19]

Vandecastele

[11] Patent Number: 5,449,885

[45] Date of Patent: Sep. 12, 1995

[54] METHOD FOR PREPARING A HEATER GLAZING FOR A REFRIGERATED DISPLAY CASE

[75] Inventor: Bruno Vandecastele, Chateau sur Marne, France

[73] Assignee: Saint-Gobain Vitrage International, Courbevoie, France

[21] Appl. No.: 294,782

[22] Filed: Aug. 23, 1994

Related U.S. Application Data

[63] Continuation of Ser. No. 846,161, Mar. 5, 1992, abandoned.

[30] Foreign Application Priority Data

Mar. 5, 1991 [FR] France ..... 91 02616

[51] Int. Cl.[6] ..... H05B 3/84

[52] U.S. Cl. ..... 219/522; 219/547; 62/248

[58] Field of Search ..... 219/201, 218, 203, 547, 219/522, 543, 549; 312/116, 114; 62/248, 458

[56] References Cited

U.S. PATENT DOCUMENTS

| | | | |
|---|---|---|---|
| Re. 25,711 | 1/1965 | Gaiser | 156/101 |
| 2,447,759 | 8/1948 | MacMaster | 62/458 |
| 2,506,977 | 5/1950 | Tortorelli | 62/248 |
| 3,892,947 | 7/1975 | Strengholt | 219/522 |
| 3,968,342 | 7/1976 | Inaba | 219/203 |
| 4,127,763 | 11/1978 | Roselli | 219/203 |
| 4,260,876 | 4/1981 | Hochheiser | 219/497 |
| 4,382,177 | 5/1983 | Heaney | 350/1.4 |
| 4,733,504 | 3/1988 | Lindgren | 52/1 |
| 4,848,444 | 7/1989 | Heinle | 428/460 |

FOREIGN PATENT DOCUMENTS

| | | | |
|---|---|---|---|
| 1101546 | 10/1955 | France . | |
| 3241622 | 5/1984 | Germany | 312/116 |
| 1378925 | 12/1974 | United Kingdom . | |
| WO85/02649 | 6/1985 | WIPO . | |

OTHER PUBLICATIONS

Thin Solid Films, vol. 193/194, Nos. 1/2, Dec. 15, 1990, pp. 730–741, C. G. Granqvist: "Window Coatings For The Future".

*Primary Examiner*—Mark H. Paschall
*Assistant Examiner*—Michael D. Switzer
*Attorney, Agent, or Firm*—Oblon, Spivak, McClelland, Maier, & Neustadt

[57] ABSTRACT

A display glazing which is fitted to a refrigerated display case and which prevents moisture condensation thereon, comprising a shaped glazing having at least a portion of one side thereof provided with a low emissivity coating, conductive current input strips placed on the glazing in contact with the low emissivity coating which define coated zones of the glazing which are heated by the Joule effect upon the passage of electrical current between the conductive strips, and a means for determining if atmospheric conditions are such that condensed moisture is likely to form on the exterior surface of the unheated glazing.

4 Claims, 2 Drawing Sheets

METHOD FOR PREPARING A HEATER GLAZING FOR A REFRIGERATED DISPLAY CASE

This application is a continuation of application Ser. No. 07/846,161, filed on Mar. 5, 1992, now abandoned.

BACKGROUND OF THE INVENTION

1. Field of the Invention

The present invention relates to a display counter fitted with a glazed part for the display of cold or deep-frozen products.

2. Description of the Background

When products stored in a refrigerated container must remain visible, as is the case in commercial premises, the container is fitted with glazed parts which convert it into a refrigerated display case. A number of alternative forms of these display cases exist. Some are cabinet-shaped in which case the door itself is transparent. Other cases are chests and it is the horizontal lid which is glazed to enable the contents to be inspected. The present invention relates more especially to display counters. In display fixtures of this type the display case generally separates the public from the merchant who alone has access to the merchandise, while the latter must be perfectly visible to the customers. As a result, clouding of the glazed parts of the. display cases with condensation must be avoided.

The method which is employed to prevent condensation generally consists in maintaining the side of the glazing facing the environment at a temperature which is higher than the dew point of the atmosphere in question. This objective is attained by increasing the insulating performance of the glazing and sometimes, in addition, by heating the surface facing the "warm+ side. The simplest means for improving the thermal insulation performance of a single glazing is to replace it with a multiple glazing. This technique is easy to use in the case of display cabinets or in the case of display chests; in fact, multiple glazings consisting of two or more flat glasses mounted parallel to each other are easy to fit into cabinet doors or chest lids. In the ,case of counter displays, for reasons of fitting, the insulating glazing solution is appropriate only to mixed alternative forms which include parts which are opaque and others which are transparent. In the case of a wholly glazed wall, various remedies exist, i.e., heat input or blowing warm air at the bottom part or else localized doubling of the glazing by virtue of an added supplementary glazed component.

The problems linked with condensation on glazings fitted to enclosures where cold or deep-frozen products are stored have received a certain number of known solutions. For instance, U.S. Pat. No. 4,382,177 relates to single or double glazings fitted into the vertical doors of refrigerated cabinets or horizontal lids of deep-freeze chests. The surface of these glazings which faces the cold side is covered with a film, itself covered with a thin coating which reflects infrared radiation. A single glazing equipped in this manner has improved thermal insulation properties and thus functions in a manner which is similar to that of a traditional multiple insulating glazing. Since the insulation is improved on the cold side, the warm face is warmer and condensation forms thereon in the instances when the surrounding air has a higher water content. However, the improvement remains moderate, when the temperature rises slightly and the difference in the moisture content of the atmospheres which cause condensation in the two cases is small.

In the case of a refrigerated chest, Patent Application EP 236,286 discloses a similar solution which is an infrared-reflecting coating on the cold side of the glazing. This solution limits condensation on the lid when it is open, in a vertical position, as a result of its swivelling about a horizontal axis.

The methods for depositing thin conductive or semiconductive coatings which also have the property of reduced emissivity, on glass, are many. A number of means are known, in particular, which make it possible to pyrolyze on the hot glass organic salts which are converted into conductive oxides. Among these methods, that of Patent EP 125,153 allows a thin coating, based on fluorine-doped tin oxide, to be deposited continuously on flat glass between the exit of a float bath and the entry into the annealing chamber. This process makes available glass sheets with a transparent and conductive coating of undefined dimensions at a low cost of manufacture. These practically invisible thin coatings have good low-emissivity and electrical conductivity properties. A need therefore continues to exist for a display glazing of improved ability to prevent vision obscuring surface condensed moisture.

SUMMARY OF THE INVENTION

Accordingly, one object of the present invention is to prevent condensation on a refrigerated display case fitted with an electrically heated single glazing which has been provided with a low-emissivity conductive coating and which is heated by the Joule effect only if the conditions for condensation are all present. A mist detector is employed to control the heating.

Another object of the invention is to provide a device formed of a low-emissivity coating, strips for current input allowing the coating to be heated by the Joule effect and means for determining whether the condensation conditions are all present.

Still another object of the invention is to provide a single glazing for fitting to a display counter which will limit condensation thereon without causing overheating, which is cheap to install and operate and which is easy to manufacture.

Briefly, these objects and other objects of the present invention as hereinafter will become more readily apparent can be attained by a display glazing for fitting to a refrigerated display case and which prevents moisture condensation thereon which comprises a shaped glazing having at least a portion of one side thereof provided with a low emissivity coating, conductive current input strips placed on the glazing in contact with the low emissivity coating which define coated zones of the glazing which are heated by the Joule effect upon the passage of electrical current between the conductive strips, and a means for determining if atmospheric conditions are such that condensed moisture is likely to form on the exterior surface of the unheated glazing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the glazing of the invention heating by the Joule effect may affect only a part of the surface of the single glazing. In one embodiment, the entire length of a glazing is provided with horizontal current input strips. In another embodiment, the current input strips are each situated in a vertical plane, with these strips being shorter than the dimension of the glazing in their vertical plane. A low-emissivity coating is provided on the glazing which is preferably interrupted between the part of the surface of the single glazing which is subjected to heating by the Joule effect and the remainder of the surface. This interruption may consist of a narrow line which joins the ends of the input strips. The low-emissivity coating is a coating of a semiconductive oxide comprising fluorine- or chlorine-doped tin oxide, tin-doped indium oxide, antimony-doped tin oxide or aluminum-doped zinc oxide.

An aspect of the invention is the use of a monolithic glazing fitted with a low emissive conducting coating in a refrigerated display case in order to prevent condensation of water vapor and, when the coating is on the inside, the low emissive conducting coating is used in order to reduce the heating of the displayed foodstuffs.

Display counters are increasingly to be found in supermarkets, hypermarkets and restaurants, where the customers are on one side of the display case without being able to touch the merchandise which is displayed, while the sales personnel are on the other side or, at least, have access to the merchandise displayed; they can identify and grasp the products pointed out by the customer who, for his part, has had all the ease of selecting what he wants. It is particularly foodstuff products, such as meat, cheeses or pastries which are displayed in these display cases. Glass is therefore preferred to plastics for fitting to the glazed parts of these display cases; its ease of cleaning, its very good resistance to scratching and its cost make it the ideal material for this application. Its high elasticity modulus and its ease of shaping encourage its use on its own without any framing, in a self-supporting structure.

Figure 1:
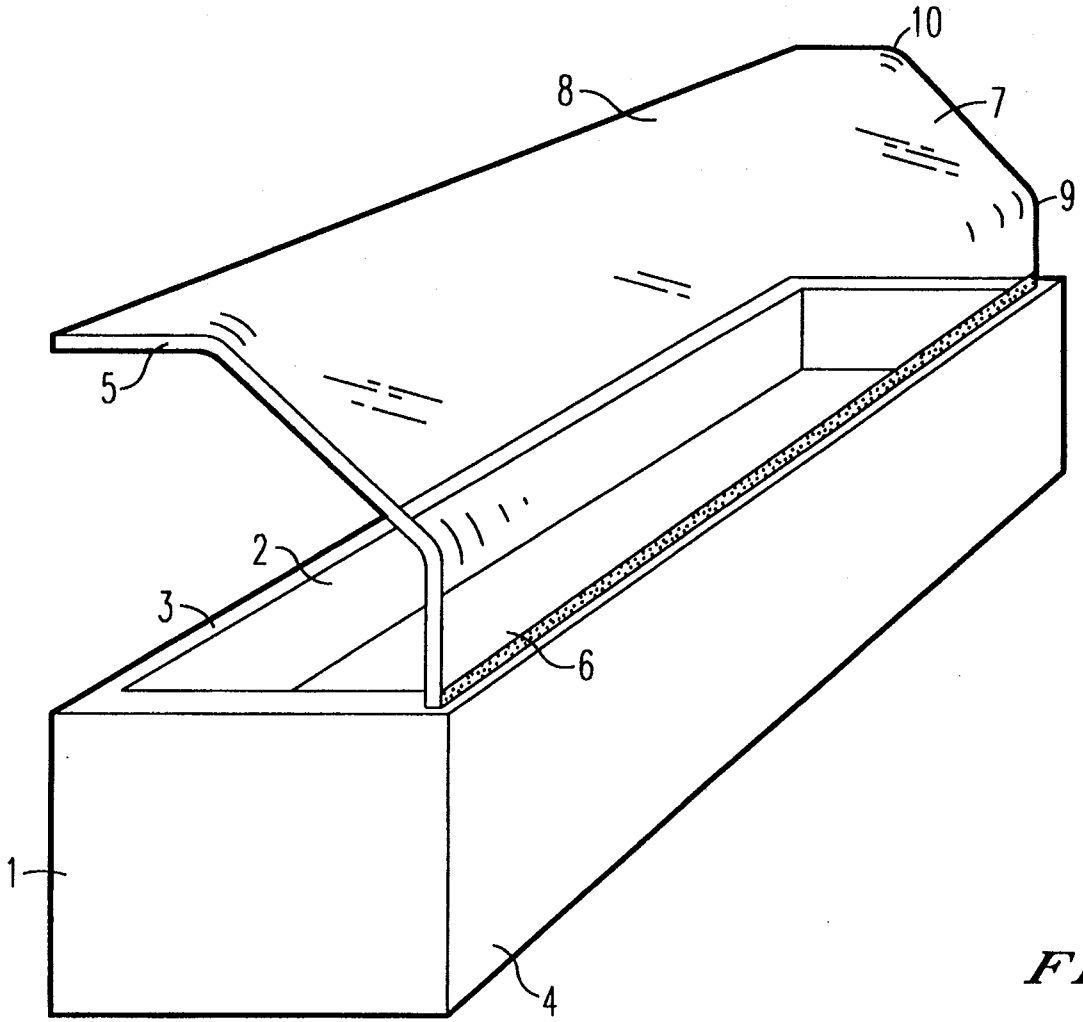
FIG. 1 shows an embodiment of the display counter of the invention.

A display counter of the type in question is shown in FIG. 1. It comprises a chest 1 intended to receive in its top part 2 the products which are to be displayed. The wall 3 consists of insulating materials which limit heat losses. The cooling systems and the control are generally kept together in the bottom part 4 of the chest. The glass sheet 5 is heat-shaped so as to give it a functional shape of the type shown in FIG. 1. The drawing shows a prismatic shape consisting of three flat members 6, 7 and 8 joined by two curved regions 9 and 10. The shapes can vary but they are generally prismatic with possibly a number of flat parts which is other than three. The glazing is generally a safety glazing of the laminated or, more commonly, quenched type. The bending of such prismatic members is advantageously done by the device described in U.S. patent application Ser. No. 07/684,376 filed on Apr. 12, 1991. In addition to the ease with which it makes it possible to obtain products of a complicated shape with a very good quality, in particular from the aesthetic viewpoint, this process avoids elongation of the glass.

The side members which support the prismatic glazing at its ends are not shown in FIG. 1. If the display counter is insulated and therefore comprises only a single member such as that shown in FIG. 1, it uses opaque or transparent sheets which prevent the circulation of the air at the ends of the display case. The connection between the side sheets and the glazing is then made by a rigid section which may be fitted with seals. When a number of members of the type in FIG. 1 are used in combination one after the other to form a counter, the vertical dividing sheets may be left out and optionally replaced by vertical support rods combined with seals which join the glazings 5 to each other. In the bottom part of the glazing, the latter is supported by a U-shaped section fitted with an elastomer seal. Frequently here a hinge is provided which makes it possible to open the display case completely for cleaning or for displaying the merchandise.

Various methods have been proposed for limiting condensation, especially in the regions 6, 9 and 7, which are the most useful areas to observe the displayed merchandise. One of these consists in placing at the bottom part of the display case, inside, a flat glass strip which is substantially parallel to the region 6 of the display case and is placed at a short distance from the latter. It thus plays a part which is similar to that of an insulating glazing and therefore makes it possible to limit the cooling of the bottom part of the glazing 5 and thus to delay the appearance of condensation. Another method consists in arranging a manifold for blowing dry and/or warm air at the bottom part of the display case 5, outside, over its whole length. The dew point of the atmosphere in which the surface of the region 6 of the glazing is situated is thus elevated. Since, in addition, its temperature rises by virtue of the circulation of the (warm) air, the two phenomena retard and often prevent mist formation. Other methods consist in heating the bottom part of the display case indirectly or directly; either a heating tape is laid at the bottom of the glazing or the latter is fitted with resistors deposited on its surface, in the same way as those existing on the heated rear windows of motor vehicles. The latter technique, which overheats the place where the resistors are situated to obtain an average temperature of the whole glazing is liable to produce a localized heating of the goods which are exposed and, possibly, their deterioration.

Each of the above solutions has disadvantages, either of an aesthetic nature in the case of the lining glass strip (which it is, furthermore, difficult to clean) and in that of the solution of the "heated window" type, or else they are inconvenient for the public, like blowing air, or even, which is more serious, the methods selected are ,detrimental to the main function of a refrigerated display counter, which is the preservation of the goods on display. This applies to all the methods which heat the glazing to a temperature markedly above its natural equilibrium temperature in its function of a wall thermally separating two environments, one cold, the other warm. The heated wall radiates thermal (infrared) energy which is absorbed by the foodstuffs and which heats them.

In the present invention a low-emissivity semiconductive coating based particularly on a doped metal oxide such as fluorine-doped tin oxide or tin-doped indium oxide (ITO) is provided as a thermal insulator, to which the function of a heating element may be added at will. Condensation is prevented in this way by virtue of a two-stage action, first of all keeping the outer surface of the display case at a higher temperature than would be the case without the coating and then, if need be, that is to say, if the moisture content of the surrounding atmosphere requires, heating this same surface to a higher temperature. Among the different methods for depositing semiconductive coatings on the glass, some produce coatings which exhibit a brittleness of a particular type—this is the case, inter alia, of very thick coatings When the coated glass is being treated in order to heat it, bend it or temper it, the glass surface which carries the coating is caused to lengthen, the coating can then craze and this disturbs the electrical conduction. When such coatings are employed it is essential to avoid allowing any stretching of the surface which carries the coating. From this viewpoint, the method of bonding of the glass of French Patent Application 90/04,806 guarantees that such stretching will not be produced. Similarly, producing a bend in which the coating would be on the convex side will be avoided.

Figure 2:
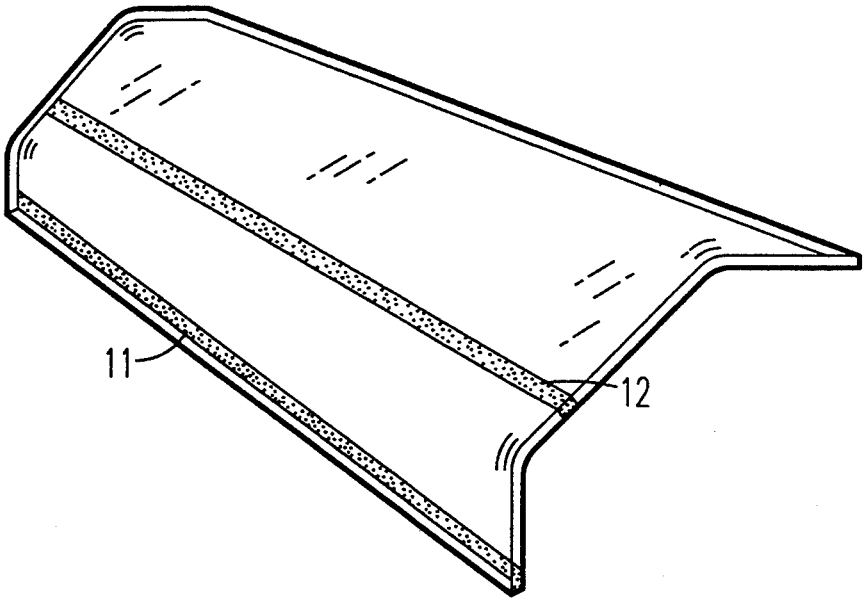
FIG. 2 is an example of an embodiment of the glazing of the display case of the invention.
Figure 3:
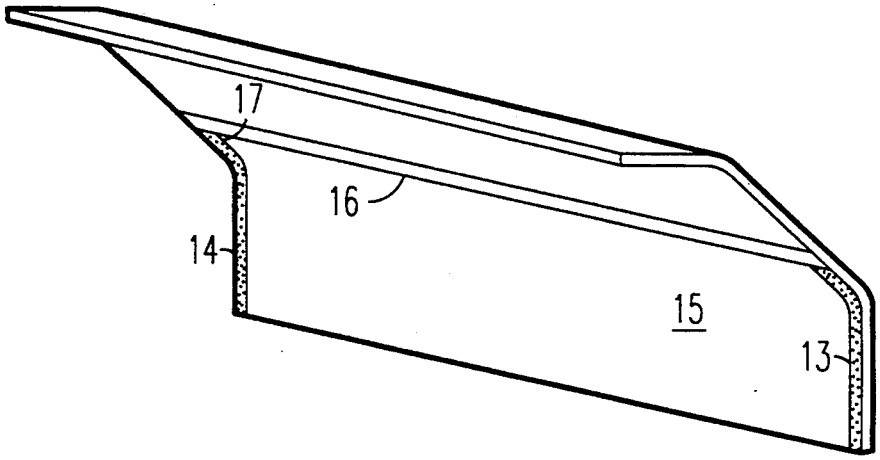
FIG. 3 shows the preferred alternative form of this same glazing.

FIGS. 2 and 3 show useful embodiments of the invention.

FIG. 2 shows an example of coated glazing, bent and then quenched so as to form the front face of a display counter; the base glass employed is a float glass 6 mm in thickness. On leaving the float bath, before annealing in the chamber, it has undergone a treatment in which a powder of an organometallic tin and fluorine compound is pyrolyzed according to the process of European Patent EP 125,153 B. The characteristics of this coating are, for example, a thickness of 200 nm and a surface resistance of 50 ohms per square. After the glass rectangle has been cut to the desired dimensions and after mechanical treatments of the edges, two current input strips 11 and 12 were deposited on the side of the coating, parallel to the longer side of the rectangle. They consist of a silver-based paste suited for good adhesion to the conductive coating and permitting the welding of the heat conductors, for example reference ES 574,804/01 from Degussa. Once baked, the strips 11, 12 have a width of 3 mm and a thickness of 20 μm, these two values being related to the intensity of the current which is intended to be passed through the conductor. After drying of the silver paste, the latter is covered with a protective coating made of an enamel from the same manufacturer with reference: series VR-HPC. Only the locations intended to receive the electrical connections at least at one of the ends of the strips 11, 12 are not given the benefit of this protection. This second enamel coating overlaps the first by approximately 1 mm on each side. The distance between the electrodes is, for example, 40 cm, and this makes it possible to have available an electrical power of 72 watts per square meter when employing a voltage of 24 volts.

When a display counter consists of a number of components identical with that in FIG. 2, placed end to end, an electrical connection can be established between successive sheets at the electrodes 11, 12, by virtue of H-shaped riders fitted with springs; the connections are greatly simplified thereby. Similarly, the metal components which are frequently used to support the vertical parts of the display counters in the region where two adjoining glazings are connected are advantageously used to connect the electrodes to the source of current.

After deposition of the pastes intended, and after baking, to form enamels, the sheet is carried into a vertical oven, where it is supported by supports, for example of the type of those described in French Patent Application No. 90/04,806. After heating, a press performs the bending and immediately on leaving the press, the sheets are quenched by blasts of air jets.

Tests were carried out during the development of the techniques of the invention. These involved measuring the comparative efficiency of a traditional glazing such as that of FIG. 1, equipped with a single quenched glass and of a glazing according to the invention like that of FIG. 2 with a coating of 80 ohms per square in four cases: without heating, with 30 $W/m^2$ (distance between electrodes 62 cm at 24 volts), 72 $W/m^2$ (40 cm) and 200 $W/m^2$ (24 cm).

The comparison was performed with a laminated glazing fitted with a heating interlayer whose power was adjusted by varying the supply voltage.

The glazing was fitted in a display case where alimentary products at 6° C. were displayed while the room environment was at 20° C. The results are summarized in the following table; the temperatures reached by the outer surface of the glazing are shown therein:

| Power $W/m^2$ | Single glass °C. | Coated glass °C. |
|---|---|---|
| 0 | 14.0 | 15.5 |
| 30 | 16.0 | 18.0 |
| 72 | 19.0 | 21.6 |
| 200 | 28.3 | 32.4 |

From these examples it can be seen that the temperature rise ranges from 1.5° C. (without electrical input) to 18.4° C. (with 200 $W/m^2$).

The examples of quenched single glazings covered with a semiconductive coating of the fluorine-doped $SnO_2$ type, which is obtained by pyrolysis of pulverulent organometallic compounds, do not limit the means of the invention. It has already been seen that ITO-based semiconductive coatings are also suitable. Similarly, powder pyrolysis may be replaced by liquid pyrolysis. However, any low-emissivity and rather transparent conductive coatings are suitable. This applies, for example, to ITO coatings deposited on cold glass, in a subsequent stage, by cathode sputtering techniques like those described in European Patent Application EP 350,362 A. Similarly, placing a low-emissivity conductive film on a glazing of a conventional display case like that of FIG. 1, insofar as the glazing thus fitted reproduces the characteristics of the invention, forms part of the techniques of the latter.

In an alternative form of the glazing of FIG. 2, the glazing is fitted with a mist detector, not shown. This makes it possible to heat the glazing only when it is needed. A number of systems have been proposed; they are intended to be fitted to the heated rear windows of motor vehicles. They involve, for example, patches of conductive enamels deposited on the rear face of the glazing, at the spot where condensation occurs first of all, that is to say preferably in the middle at the bottom. The patch comprises two electrodes in the form of a comb whose teeth intermesh. An electronics system connected to the electrodes is sensitive to the variations in electrical conduction which are related to the moisture content of the glass surface. It switches on the means of heating. Such a device is described, for example, in Patent FR 2,127,059. When combined with the display case of the invention, it provides access to a highly efficient system which uses energy very economically. Furthermore, the limitation of the temperature increase to a strict minimum, added to the low emission of infrared radiation from the glazing of the invention towards the goods displayed in the refrigerated display case, guarantees that these goods will not degrade as a result of local overheating.

The glazing of FIG. 2 is highly effective; however, the electrode 12 which passes through the field of vision of the observer looking at the products displayed in the display case may be considered to be unaesthetic, or even a nuisance. This is why the preferred form of the invention, which is shown in FIG. 3, does not comprise this horizontal electrode. Instead, two electrodes 13 and 14, which are parallel to the short sides of the glazing and situated in vertical planes have been arranged; their length is limited to the region which must be heated. Only two electrodes have been shown in the figure. However, given the value of the surface resistance of the conductive coating (generally between 50 and 10 ohms per square) and depending on the desired power per unit area, while taking into account the acceptable electrical voltage (at most 24 or possibly 48 volts), it may be necessary to add one or more intermediate electrodes. The ,electrodes are in all respects identical with those described when dealing with the alternative form shown in FIG. 2.

While the technique of deposition of the thin low-emission and transparent conductive coating permits a partial deposition on the glass surface, it may be advantageous to limit the deposition of the coating to the surface included between the electrodes. In this case, the coating would cover only the region 15 and would be limited by a line of appropriate shape joining the ends of the electrodes 13, 14 like, for example, line 16.

When the coating is continuous and also covers the region 17 in the upper part of the glazing, highly localized heating may be produced around the ends of the electrodes 13, 14. There exist, in fact, a number of lines of current originating from these points and irradiating not only in the region 15 but also in a considerable part of the region 17. This phenomenon may be considered awkward by users. In this case, another embodiment of the invention eliminates the electrical conduction of the coating over a narrow strip between the regions 15 and 17, thereby forming an insulating strip. A technique which is commonly employed to remove semiconductive oxide coating consists in treating the coating with nascent hydrogen. The stages of the process are:

i) Deposition of zinc powder from a suspension in a solvent and along the line to be treated by silk-screen printing;

ii) Drying of the deposit;

iii) Spraying hydrochloric acid onto the zinc deposit; the nascent hydrogen destroys the coating.

Another technique which can be employed to create a narrow insulating strip between regions 15 and 17 is the electroerosion method described in European Patent EP 154,572 B. It is obviously also possible to provide for the deposition of a mask before the deposition of the coating on the glass, such as for example a mask based on iron oxide in suspension, deposited by silk-screen printing, which will prevent contact between the coating and the glass and which can be removed subsequently.

The conductive coating can also be interrupted practically invisibly and the creation of hot spots at the ends of the electrodes is then avoided.

By virtue of the techniques just described, and as shown by the results of the measurements carried out, the invention makes it possible to produce glazings intended to be fitted to refrigerated display counters, where condensation is practically impossible, thereby providing elegant, efficient and economically satisfactory display counters of improved insulation. These results are obtained while avoiding the usual disadvantages such as interference with visibility to the customer who looks at the merchandise, unnecessary heating of the displayed products, high installation or operating cost, and the like.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method of preventing moisture condensation on the display single glazing of a refrigerated display case, comprising:

providing at least a portion of the inside surface of the display glazing with a low emissivity conductive coating and conductive strips for current input placed in a vertical plane and being shorter than the dimension of the glazing and the low emissivity conductive coating in their vertical plane in contact with the coating which define at least one heating zone;

applying electrical current to the conductive strips to generate heat by the Joule effect in the coating bounded by the conductive strips if atmospheric conditions are such that moisture condensation is likely to occur on the glazing, and wherein the low-emissivity coating is interrupted by an insulating strip between the part of the surface of the single glazing which is subjected to heating by the Joule effect and the remainder of the surface along a line which joins the ends of the current input strips.

2. The method of claim 1, wherein a mist detector is employed to control heating of the glazing as it determines the moisture conditions of the atmosphere.

3. The method of claim 1, wherein said mist detector is on the outside surface of the glazing.

4. A method of providing a refrigerated display case with a display glazing which prevents the formation of vision obscuring surface condensed moisture, which comprises:

equipping said display case with a display glazing comprising:

a shaped single glazing having at least a portion of its inside surface thereof provided with a low emissivity coating;

conductive current input strips placed in a vertical plane, said input strips being shorter than the dimension of the glazing and the low emissivity conductive coating in their vertical plane, on the glazing in contact with the low emissivity coating which define coated zones of the glazing which are heated by the Joule effect upon the passage of electrical current between the conductive strips, wherein the low-emissivity coating is interrupted by an insulating strip between the part of the surface of the single glazing which is subjected to heating by the Joule effect and the remainder of the surface along a line which joins the ends of the current input strips; and a means for determining if atmospheric conditions are such that condensed moisture is likely to form on the exterior surface of the unheated glazing.

* * * * *

UNITED STATES PATENT AND TRADEMARK OFFICE

CERTIFICATE OF CORRECTION

PATENT NO. : 5,449,885

DATED : September 12, 1995

INVENTOR(S) : Bruno VANDECASTELE, et al.

It is certified that error appears in the above-indentified patent and that said Letters Patent is hereby corrected as shown below:

On the title page, Item [54] and Column 1, Lines 2 and 3, the title should read:

--METHOD FOR PREPARING A HEATED GLAZING FOR A REFRIGERATED DISPLAY CASE--

Signed and Sealed this

Twenty-first Day of November, 1995

Bruce Lehman

*Attest:*

BRUCE LEHMAN

*Attesting Officer*

*Commissioner of Patents and Trademarks*